US005868095A

United States Patent [19]

Zeromski et al.

[11] Patent Number: 5,868,095

[45] Date of Patent: Feb. 9, 1999

[54] INFLATABLE FLOOR, IN PARTICULAR FOR AN INFLATABLE BOAT

[75] Inventors: Dominique Zeromski; Lionnel Braud, both of Villenouvelle, France

[73] Assignee: Zodiac International, Issy Les Moulineaux, France

[21] Appl. No.: 850,926

[22] Filed: May 2, 1997

[30] Foreign Application Priority Data

Mar. 17, 1997 [FR] France ..... 97 03191

[51] Int. Cl.[6] ..... B63B 7/08

[52] U.S. Cl. ..... 114/345

[58] Field of Search ..... 114/345, 363; 441/40–42, 65, 66

[56] References Cited

U.S. PATENT DOCUMENTS

| | | | |
|---|---|---|---|
| 2,064,128 | 12/1936 | Smithers et al. | 441/66 |
| 4,462,331 | 7/1984 | McCrory | 114/345 |
| 4,752,260 | 6/1988 | Stewart | 441/65 |
| 5,273,470 | 12/1993 | Sneddon et al. | 441/65 |

FOREIGN PATENT DOCUMENTS

| | | | |
|---|---|---|---|
| 101633 | 7/1937 | Australia | 441/40 |
| 2612881 | 9/1977 | Germany | 114/345 |

*Primary Examiner*—Ed L. Swinehart
*Attorney, Agent, or Firm*—Larson & Taylor

[57] ABSTRACT

Inflatable floor (5), in particular for inflatable boats, constituted by at least one closed airtight compartment of a generally very flat shape and inflatable to a relatively high pressure, said chamber comprising two main walls (6) opposite each other formed by at least two respective sheets (7) of at least one relatively flexible and airtight material connected together by a multiplicity of flexible links (8) of approximately equal length, characterised in that one of said main walls **(6*s*) or upper wall has an external face (9) which is constituted so as to be anti-slip (11)** at least over most of its surface.

3 Claims, 2 Drawing Sheets

INFLATABLE FLOOR, IN PARTICULAR FOR AN INFLATABLE BOAT

BACKGROUND OF THE INVENTION

The present invention relates to improvements to an inflatable floor, in particular for inflatable boats, constituted by at least one watertight enclosed compartment which is generally very flat in shape and can be inflated to a relatively high pressure, said compartment comprising two main walls opposite each other, formed by at least two respective sheets of at least one relatively flexible and airtight material connected together by a multiplicity of flexible links of approximately equal length.

Inflatable floors of this type are commonly used at present as floors for inflatable boats: their structure and their high-pressure inflation afford them a high degree of rigidity; they are lightweight; by their very structure, they contribute to the overall buoyancy of the boat; finally, as they can be deflated, they can be folded and rolled into a small volume when the boat is itself deflated and folded (transport, storage).

Current floors, however, have the drawback that they are very slippery when damp or wet owing to the very smooth surface of their upper walls.

BRIEF SUMMARY OF THE INVENTION

The main purpose of the invention is to overcome this well-known drawback and to provide an improved arrangement of these floors which, while better responding to practical requirements, does not entail substantial and costly modifications to the structure and manufacture of these inflatable floors.

For these purposes, an inflatable floor as mentioned in the preamble is essentially characterised in that, being arranged according to the invention, one of said main walls, or the upper wall, has its exterior surface constituted in such a way that at least most of the surface is anti-slip.

DESCRIPTION OF PREFERRED EMBODIMENTS

The anti-slip composition of said exterior surface of the upper wall can be extended to the whole surface, or can also be extended to the whole of said surface except for a narrow peripheral strip.

The anti-slip composition can consist of an appropriate treatment of the material of the exterior surface of the exterior face of the upper wall: in particular during the manufacturing process for the sheet constituting the wall (for example by mechanically marking its exterior face during its moulding or by affixing an imprint on the hot surface material while soft) or after manufacture of said sheet (for example by mechanically engraving its exterior face).

The anti-slip composition can also consist of affixing to said exterior face of the upper wall a sheet the upper face of which has an anti-slip characteristic. Said sheet can be attached by any means known to a man skilled in the art, such as by gluing or thermal sealing.

Whatever solution is chosen, the anti-slip characteristic can be conferred by a relief (striations, pimples, etc.) provided in the upper surface of the upper wall or the affixed sheet, or it can also be conferred by the superficial deposit of a substance with an anti-slip characteristic on the upper surface of the upper wall or the affixed sheet.

In any event, obtaining a superficial anti-slip characteristic in no way modifies the basic structure of the inflatable floor, which thus retains the same advantages offered by existing inflatable floors. Moreover, the manufacturing process is not substantially modified, and the additional cost resulting from this additional arrangement remains modest.

The invention will be more clearly understood on reading the following detailed description of certain implementations of the invention, provided solely as non-limitative examples. This description refers to the annexed drawings in which.

Figure 1:
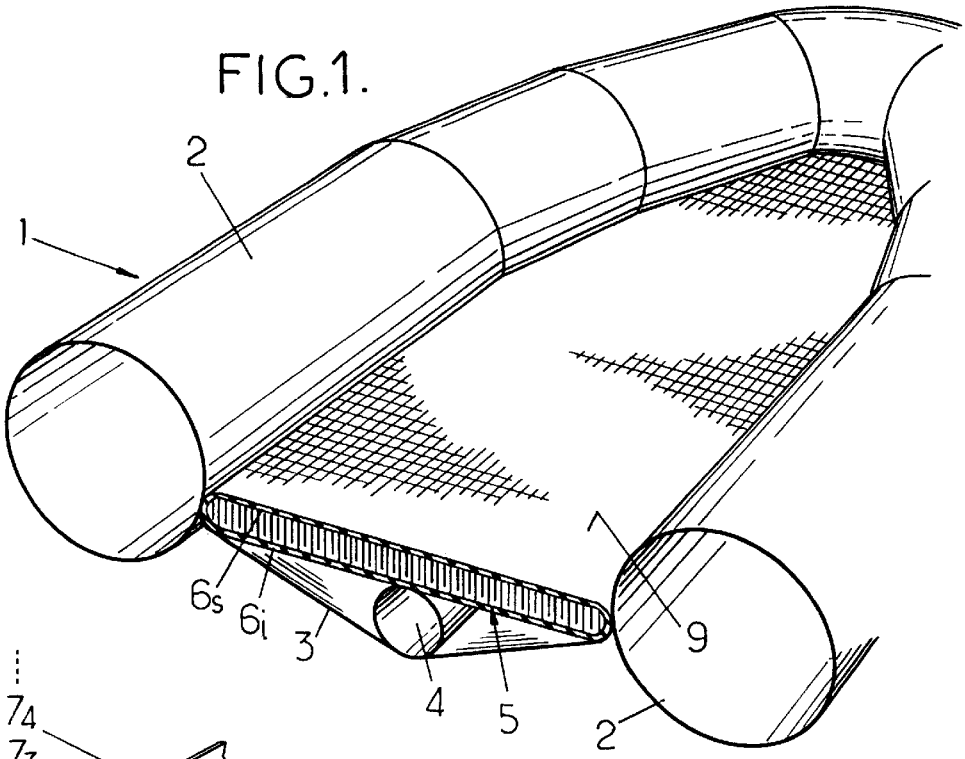
FIG. 1 is a schematic view in cross-section of an inflatable boat equipped with an inflatable floor of the type envisaged by the invention.

FIG. 1 shows an example of standard arrangements for an inflatable boat 1 equipped with two lateral inflatable tubes 2 which may join at the front of the boat and thus constitute a generally U-shaped buoyancy unit, open to the rear, surrounding a base 3 and solidly attached to it in a watertight manner. The base 3 is formed by a flexible, watertight sheet which is stretched into a general V-shape to form a keel by means of an inflatable internal tube 4 which rests on an inflatable rigid floor 5 above it.

The rigid floor 5, of an inflatable type, comprises at least one watertight enclosed chamber of a generally very flat shape and which can be inflated to a relatively high pressure. This enclosed chamber comprises two main walls 6, respectively upper 6*s* and lower 6*i*, placed opposite each other, approximately parallel to one another.

Figure 2:
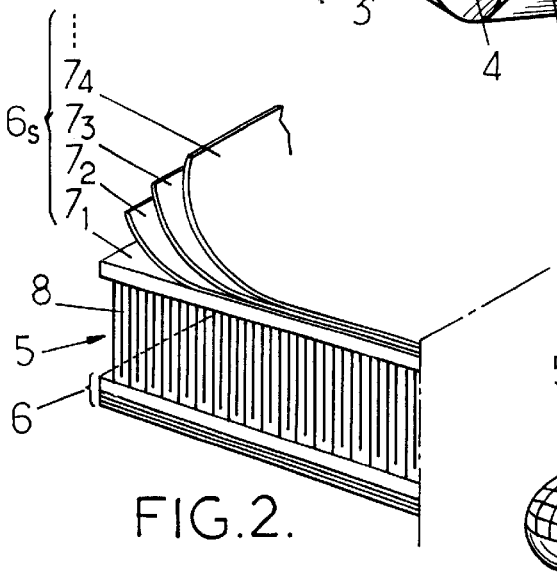
FIG. 2 is a simplified diagram illustrating the composition of an inflatable floor of the type envisaged by the invention.

As can be seen more clearly in the larger-scale fragmented view in FIG. 2, each main wall 6 is formed by at least one sheet of at least one flexible and airtight material. In general, each wall is constituted by an assembly of several sheets $\mathbf{7}_1$, $\mathbf{7}_2$, $\mathbf{7}_3$, . . . which each have specific individual compositions and characteristics (sheet in synthetic material for airtightness, cloth for reinforcement, external protective sheet, . . . ). The two walls $\mathbf{6}_i$ and $\mathbf{6}_s$ are also connected to each other by a multiplicity of flexible links such as threads 8, all of approximately the same length, anchored in the walls 6 and holding them against the separating force generated by the inflation pressure.

In current arrangements, the exterior face 9 of the upper wall 6*s* is constituted by an approximately smooth material which is very slippery when wet or dry.

Figure 3:
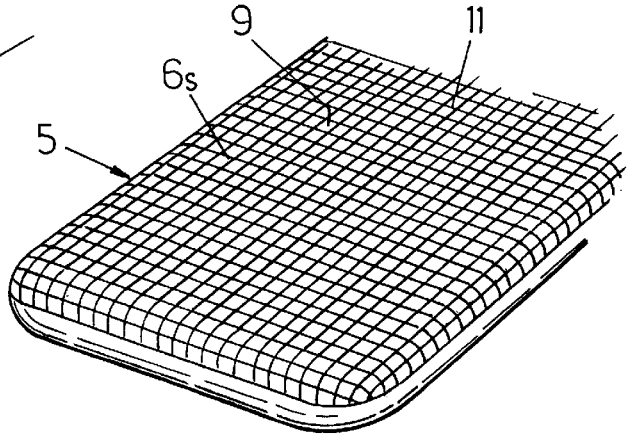
FIGS. 3 to 7 are partial schematic views illustrating respective examples of inflatable floors arranged according to the invention.
Figure 4:
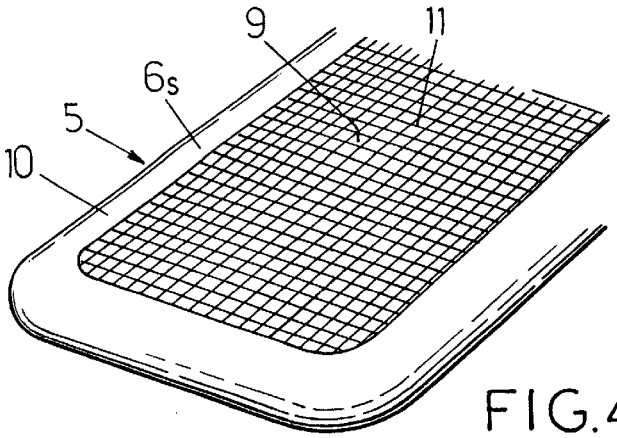

According to the invention, the upper wall 6*s* has its upper or external face 9 constituted so as to be anti-slip according to 11 at least over most of its surface, i.e. either over its entire surface as illustrated in FIG. 3 or over its entire surface except for specific areas of limited extent which are assumed not to be trodden on or to be trodden on rarely, such as the peripheral strip 10 (more or less overhung by the floatation tube) as illustrated in FIG. 4.

Figure 5:
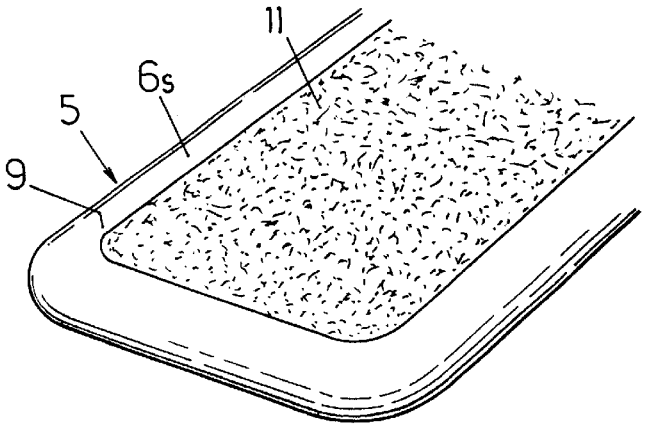
Figure 6:
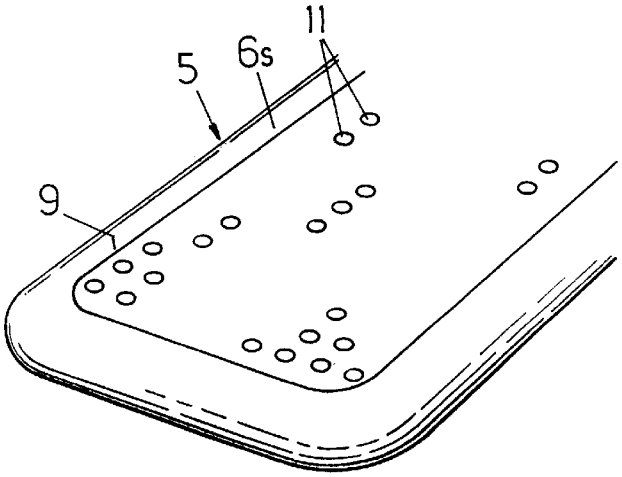

The anti-slip composition can consist of an appropriate treatment of the surface material of the external face 9 of the upper wall 6*s*: it can be for example a relief provided on this external face for example parallel striations or ribs as a grid pattern (FIG. 3 and 4), as a diamond pattern, etc.; or projecting dots (FIG. 6); or small chips close together; or graining or similar (FIG. 5), etc. These types of relief are obtained by working directly on the surface 9 of the upper wall 6*s* either during moulding of the material as it is still hot and soft when said wall is being manufactured or by subsequently using mechanical means (etching, sanding, . . . ).

Figure 7:
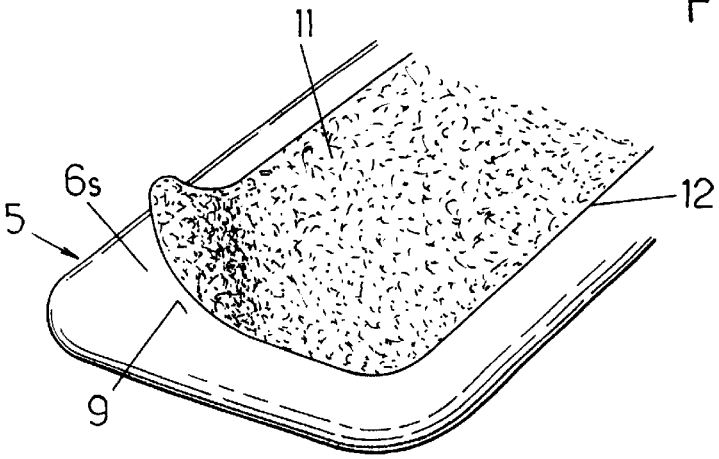

The anti-slip composition can also be obtained by affixing to the external face 9 of the upper wall 6*s* a film, a coat or a sheet 12 (FIG. 7) the upper face of which has an anti-slip characteristic. This affixing can be carried out by any means known to a man skilled in the art such as gluing or sealing the synthetic materials. A superficial deposit may also be envisaged for example by spraying a substance having anti-slip characteristics on said face 9.

It will be understood and as already results from the above, the invention is in no way limited to the methods of application and implementation which have been more particularly envisaged; on the contrary, it encompasses all variants.

We claim:

1. An inflatable floor for an inflatable boat, comprising at least one watertight closed compartment of a generally very flat shape and inflatable to a high pressure, said compartment comprising two main walls opposite each other, each of said main walls being relatively flexible and airtight and being connected together by a multiplicity of flexible links of approximately equal length, at least one of said main walls having an external face which is slippery when wet, a region of said slippery external face comprising a relief provided in said slippery external face so as to be anti-slip at least over most of its surface.

2. Inflatable floor according to claim 1, wherein the anti-slip region of said external face extends over the entire surface of said external face.

3. Inflatable floor according to claim 1, wherein the anti-slip region of said external face extends over the entire surface of said external face except for a narrow peripheral strip.

* * * * *